US005387181A

United States Patent [19]

Olsen

[11] Patent Number: 5,387,181

[45] Date of Patent: Feb. 7, 1995

[54] ENVIRONMENTALLY-CONTROLLED LOUNGE CHAIR

[76] Inventor: Robert J. Olsen, 70 Irving Pl., 5C, New York, N.Y. 10003

[21] Appl. No.: 897,025

[22] Filed: Jun. 11, 1992

[51] Int. Cl.[6] ..... A61M 9/00

[52] U.S. Cl. ..... 601/155; 5/284; 5/421; 601/158; 607/83

[58] Field of Search ..... 261/110; 297/180.15, 297/452.11, 452.12, 452.63; 5/918, 423, 284, 236.1, 461, 468, 421; 128/24.1; 600/28, 21; 607/81, 83, 84, 87, 96; 601/154–156, 158

[56] References Cited

U.S. PATENT DOCUMENTS

| | | | |
|---|---|---|---|
| 2,108,268 | 2/1938 | Petersime | 607/82 |
| 2,814,297 | 11/1957 | Stewart | 607/87 |
| 3,595,223 | 7/1971 | Castagna | 5/918 X |
| 3,757,362 | 9/1973 | Bowlin et al. | 5/423 |
| 3,826,250 | 7/1974 | Adams | 600/28 X |
| 4,141,585 | 2/1979 | Blackman | 5/423 X |
| 4,559,656 | 12/1985 | Foster | 5/236.1 |
| 4,765,542 | 8/1988 | Carlson | 297/180.15 X |
| 4,997,230 | 3/1991 | Spitalnick | 5/423 |
| 5,058,227 | 10/1991 | Schoenfelder | 5/423 X |
| 5,101,809 | 4/1992 | Daffer et al. | 607/82 X |

FOREIGN PATENT DOCUMENTS

| | | | |
|---|---|---|---|
| 2846859 | 5/1979 | Germany | 600/28 |

*Primary Examiner*—Robert A. Hafer
*Assistant Examiner*—Brian E. Hanlon
*Attorney, Agent, or Firm*—Michael Ebert

[57] ABSTRACT

A lounge chair accommodating an occupant in a reclining position while exposing him to a stress-relieving environment. The chair includes a couch whose frame supports a bed formed by an array of parallel dowels contoured to define an intermediate posterior region having extending therefrom a front thigh and leg region and rear back and head region. The bed contour is adjustable to conform to the natural contours of the occupant. The couch is mounted on a base and is angularly adjustable thereon. Supported on the frame below the bed is a water trough contoured to define an intermediate sump section having extending therefrom front and rear waterfall sections, each provided with a set of deflectors so situated as to cause the flowing water to cascade into the sump section. Coupled to the trough is a pump supplying water to the input of the front and rear waterfall sections, the water collected in the sump section being returned to the pump and recirculated. The sounds emanating from the trough simulate those of a running brook, these sounds together with mist and negative ions arising from the trough passing through spaces between the dowels of the bed to envelop its occupant in a stress-relieving environment.

14 Claims, 7 Drawing Sheets 17
23P
23
26
28
25
24
T1
13
30
T2
12
H
R
27
29
T
N
17E

ENVIRONMENTALLY-CONTROLLED LOUNGE CHAIR

BACKGROUND OF INVENTION

1. Field of Invention

This invention relates generally to lounge chairs, and more particularly to a chair of this type having a contoured bed which conforms to the natural contours of a reclining occupant, the chair incorporating a circulating water trough system which generates sounds simulating those of a running brook, these sounds together with mist and negative ions arising from the trough creating a stress-relieving environment that envelops the reclining occupant.

2. Status of Prior Art

A standard lounge chair includes a long couch whose length exceeds the average height of an adult so that its occupants may recline on the couch. Many lounge chairs include a bed which is contoured to more or less conform to the natural contours of a reclining occupant. But the contour of the bed is not adjustable; hence it may in some instances deviate from that of the occupant to a degree causing discomfort.

It is also known in lounge chairs to provide an array of parallel leather or flexible plastic straps to form a bed to accommodate a reclining occupant. The bed is divided into a front thigh and leg section and a rear back and head section whose angle relative to the front section is adjustable.

It is far more relaxing and restful for an individual to recline in a lounge chair with his legs extending in a gentle curve and his head lying on a head rest than for that individual to be seated on a conventional chair with his head unsupported and with his legs dangling from the seat. But however comfortable and relaxing the lounge chair, it does not isolate the reclining occupant from a disturbing and stress-inducing environment. In our industrial society, many individuals are subjected to high-level stress as a result of ambient noise or other factors to a degree that may impair their well being.

Thus in the case of environmental noise which acts to induce stress, it is known to mask such noise by means of a white-noise generator that produces random noises whose frequencies are dispersed throughout a broad sonic range. White noise is analogous to white light composed of all of the colors in the visible light spectrum. However, white noise does not positively act to relieve stress, but serves only to mask noises which induce stress.

The sounds having the greatest lulling effect and which act to relieve stress are usually those existing in nature. No sounds are more soothing than the sounds of a light rain heard while lying comfortably in bed, or the sounds of a gently running brook as heard while resting on the bank of the brook. While it is possible to record such sounds and to play them back, a recording of water-related sounds is inherently repetitive in nature and lacks other attributes associated with water activity.

It is not sound alone that determines whether the environmental setting of a lounge chair acts to relieve the occupant of the chair of stress, for the ambient atmosphere also plays a role in this regard.

Thus it is now the practice in many homes and buildings to seal its windows and to establish a controlled atmosphere within the interior that is almost fully isolated from an impure exterior atmosphere. To this end, use is made of an air conditioning system that recirculates the air within the interior, and in the process of doing so filters out particulate contaminants while heating or cooling the flowing air to maintain it at a comfortable, even level.

The typical air conditioning system, when heating the air flowing therethrough, will at the same time lower its humidity, so that the air in the building is dry. Also, this system, because of filtration and other factors, acts to rob the flowing air of negative ions. Hence the occupants of the building or residence are subjected to an atmosphere, though clean as compared to the exterior atmosphere, is both dry and stale and devoid of negative ions. As a consequence, these occupants, for reasons they cannot explain, often suffer from tension headaches which impair their ability to carry out their normal activity.

Yet the reason air gains freshness after a rain storm is because the resultant air turbulence acts to release negative ions into the atmosphere, the air also then being rendered moist. Even greater bursts of negative ions are produced by lightning flashes which ionize the air.

To raise the humidity of the ambient air in an occupied room, it is known to provide electrically-powered humidifiers for this purpose. And to replenish the loss of negative ions, it is known to provide electrostatic negative ion generators.

However, while it would be desirable to subject the reclining occupant of a lounge chair to lulling sounds, negative ions and a moist atmosphere so as to place him in an environment conducive to relaxation and the reduction of psychic stress, the means heretofore available for this purpose are inappropriate to the usual setting for a lounge chair.

Thus if the lounge chair is situated in a well-appointed living room or bedroom, it would interfere with this setting to also place in this room not only an electrically operated player continuously playing back a tape recording of the sounds of a running brook, but also a negative-ion electrostatic generator discharging negative ions into the room atmosphere and an electrically-powered humidifier to raise the moisture content of the room.

Where magnetic fields, such as those produced by operating electric motors and electromagnetic loudspeakers, exist in a region in which a bed or chair is placed, these fields attract negative ions in the atmosphere and thereby deplete this region of ions. Hence the placement of a negative-ion generator in this region may not result in an adequate supply of negative ions in the atmosphere.

Attempts have heretofore been made to place a chair or bed in an environment which stimulates, relaxes or otherwise treats the occupant of the chair or bed. Thus in the Adams patent, U.S. Pat. No. 3,826,250, there is disclosed a lounge chair enclosed within a housing subjecting the occupant of the chair to a controlled environment, means being provided to vibrate the occupant of the chair and to produce light and sound effects to relax or stimulate the occupant.

In the baby bed disclosed in the Cuervo patent, U.S. Pat. No. 4,785,797, an electronic sound system is provided to create the sounds of wind motion to soothe the infant occupying the bed.

Hellig, U.S. Pat. No. 3,628,829, shows a chair provided with sense stimulators including odor, sound and vibration generators.

Inasmuch as the present invention provides a lounge chair that incorporates a recirculating water system moisturizing the air and produces lulling sounds as well as negative ions, the following patents are of background interest. The Cox patent, U.S. Pat. No. 4,854,502, discloses a lounge chair provided with a sump pump unit that feeds water into a spray head to spray cooling water on the occupant of the chair. A similar arrangement is shown in the Manning patent, U.S. Pat. No. 4,846,525, but in this patent what is sprayed is a mist of water and a suntan lotion.

SUMMARY OF INVENTION

In view of the foregoing, the main object of this invention is to provide a lounge chair incorporating therein a circulating water trough system which acts to envelop a reclining occupant of the chair in a localized environment having beneficial effects.

More particularly, an object of this invention is to provide a lounge chair of the above type in which the circulating water trough system produces soothing sounds simulating those of a gently running brook together with moist air and negative ions to create a localized environment that relieves a reclining occupant of the chair of stress, so that one who occupies this chair for at least a half hour is refreshed by this experience.

A significant feature of the invention is the limited use of vibrating motors or other devices associated with the chair that create magnetic fields acting to rob the atmosphere of beneficial negative ions.

Also an object of the invention is to provide a lounge chair whose couch has a contoured bed whose contour is adjustable to the natural contour of the occupant of the bed.

Another object of the invention is to provide a lounge chair having an adjustable lower back support adapted to engage the lower lumbar area of the occupant and an adjustable head rest adapted to engage a pressure point in the occipital region on the rear of the occupant's skull, such engagement relieving tension.

Still another object of this invention is to provide a lounge chair that includes a couch having a contoured bed, the couch being mounted on a base and being angularly adjustable so as to raise or lower the front or rear of the bed relative to the base. By raising the feet of the occupant so that it is higher than his head, one then reverses the negative effects of gravity.

Yet another object of this invention is to provide a lounge chair whose couch is formed by a frame supporting an array of parallel, flexible dowels which is adjustably contoured to conform to the natural contour of the occupant of the bed. Because the dowels are spaced from each other, the body of the occupant is permitted to "breathe" and expel moisture.

Briefly stated, these objects are attained in a lounge chair accommodating an occupant in a reclining position while exposing him to a stress-relieving environment. The chair includes a couch whose frame supports a bed formed by an array of parallel dowels contoured to define an intermediate posterior region having extending therefrom a front thigh and leg region and rear back and head region. The bed contour is adjustable to conform to the natural contours of the occupant. The couch is mounted on a base and is angularly adjustable thereon.

Supported on the frame below the bed is a water trough contoured to define an intermediate sump or reservoir section having extending therefrom front and rear waterfall sections, each provided with a set of deflectors so situated as to cause the flowing water to cascade into the sump section. The deflectors are configured to create the sounds of a natural brook in which water rolls onto its self. Coupled to the trough is a pump supplying water to the input of the front and rear waterfall sections, the water collected in the sump section being returned to the pump and recirculated. The sounds emanating from the trough simulate those of a running brook, these sounds together with mist or moist air and negative ions arising from the trough passing through spaces between the dowels of the bed to envelop its occupant in a stress-relieving environment.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
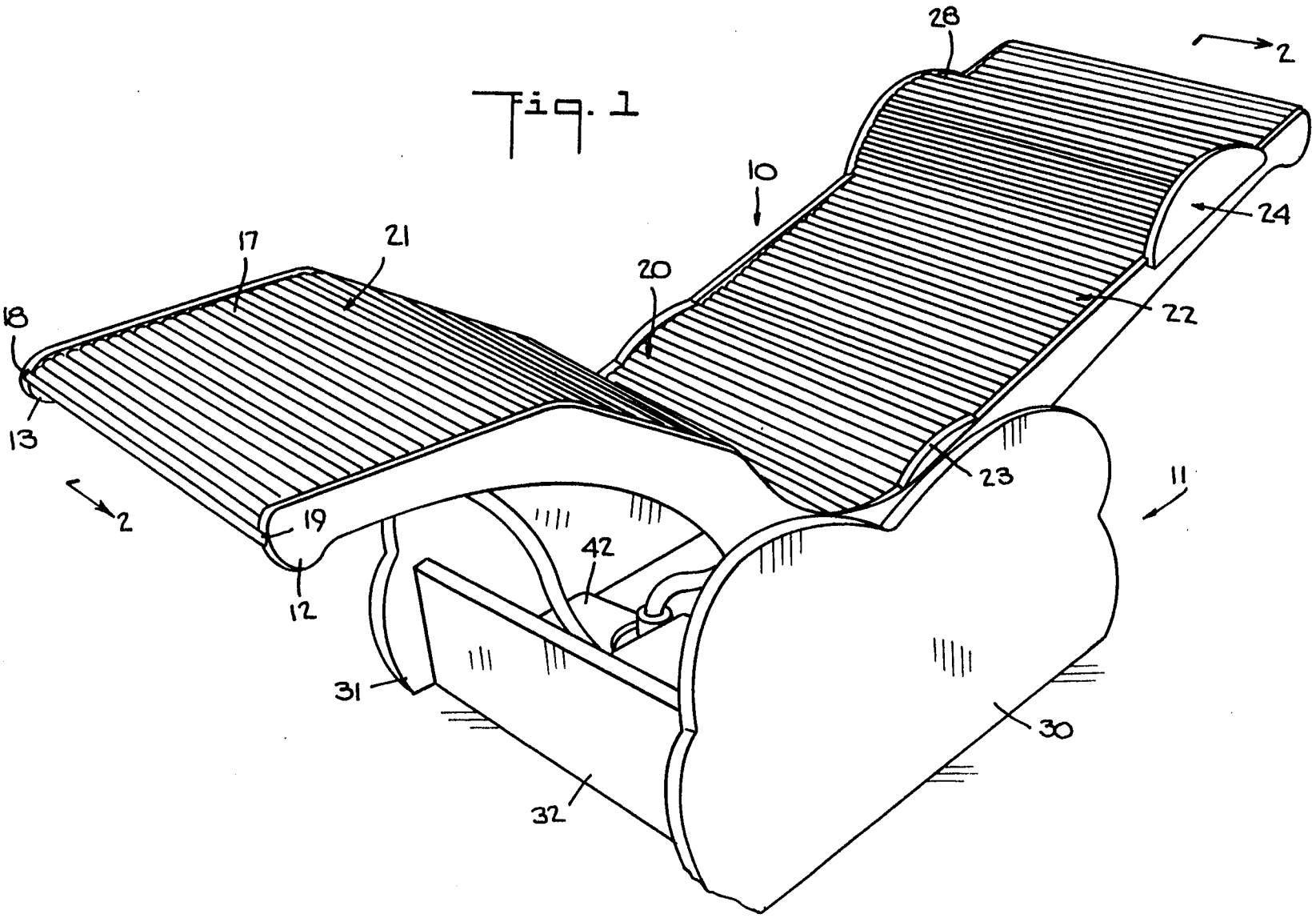
FIG. 1 is a perspective view of a lounge chair according to the invention.
Figure 2:
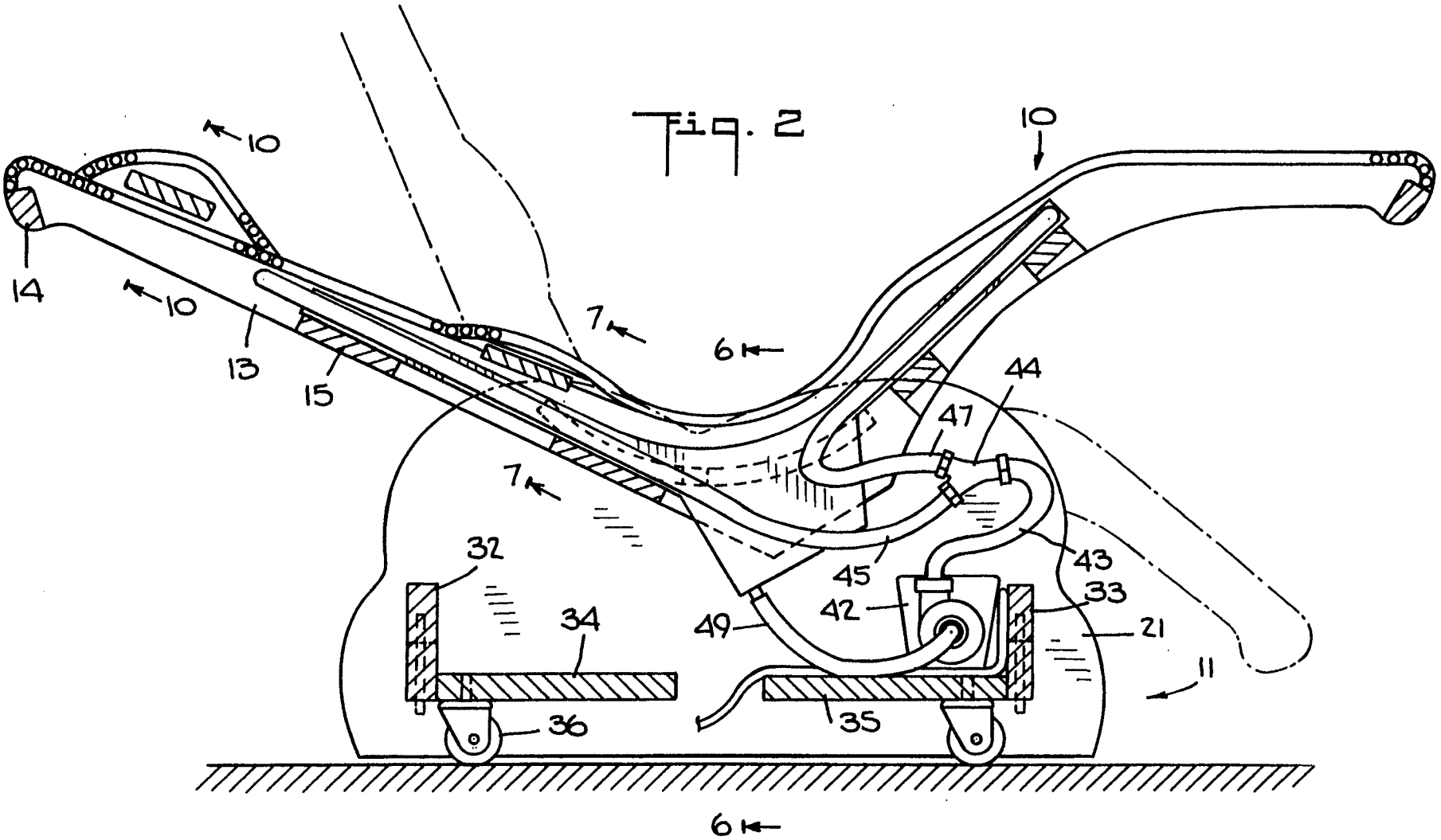
FIG. 2 is a longitudinal section taken through the lounge chair in the plane indicated by line 2—2 in FIG. 1.
Figure 3:
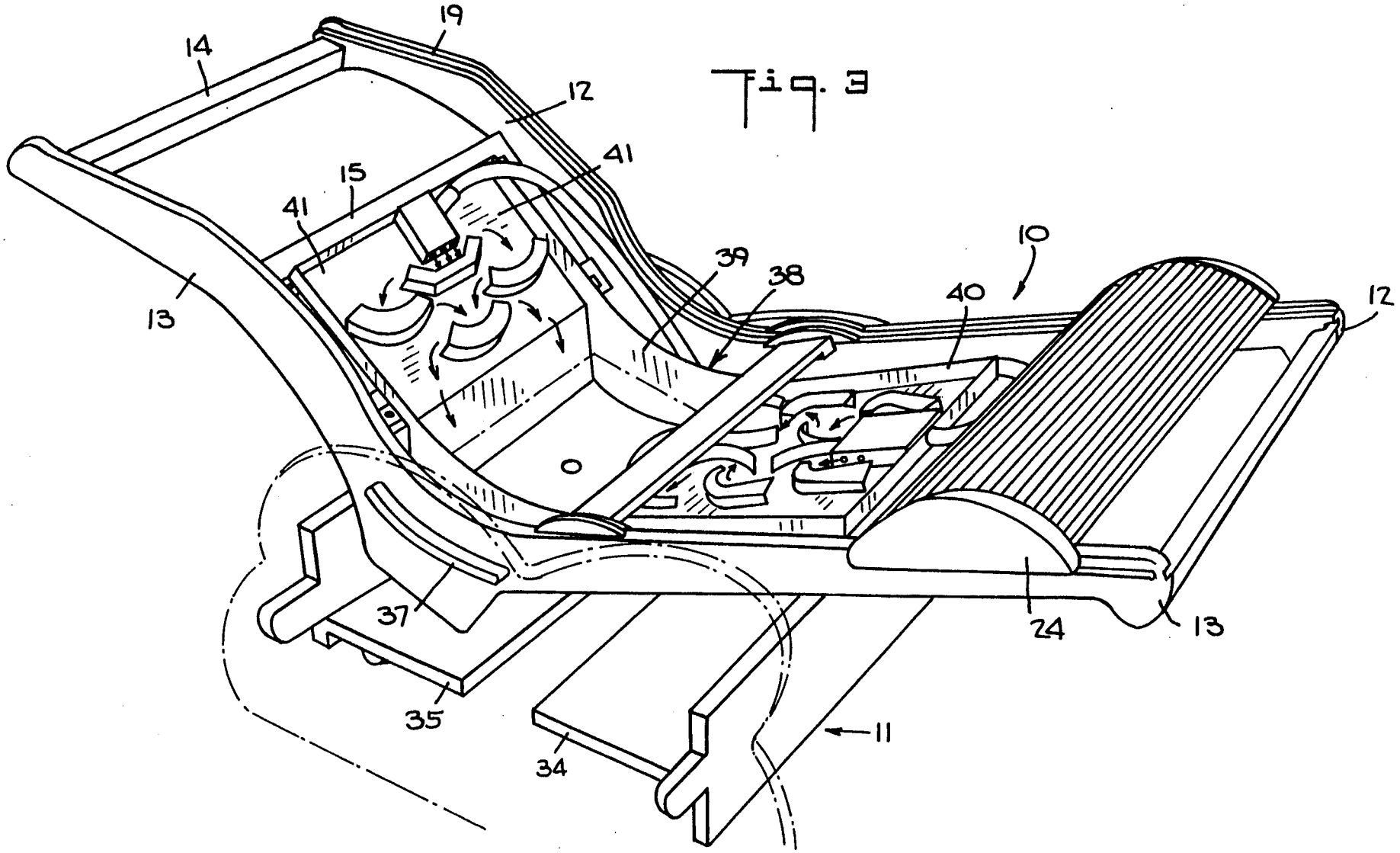
FIG. 3 is a perspective view of the lounge chair with some parts removed to expose the water trough mounted on the frame of the couch.

Referring now to FIGS. 1 to 3, there is shown a lounge chair in accordance with the invention whose main components are a couch, generally designated by reference numeral 10, and a base, by numeral 11. Couch 10 is mounted on base 11 and is angularly adjustable relative to the base.

Couch 10 includes a frame formed by a pair of parallel contoured side boards 12 and 13 bridged by cross pieces, such as pieces 14 and 15. In practice, the frame of the couch may be made of mahogany, redwood or spruce, although other materials, such as aluminum, steel, polypropylene or other synthetic plastic may be used to fabricate the frame.

Supported on the frame and running its full length is a bed 17 formed by an array of parallel dowels, preferably made of birch or maple. The dowels are joined together in spaced apart relation by a pair of fabric tapes T each passing through slots cut into the ends of the dowels to form a mat (see FIG. 14).

The extremities of the dowels which form the mat are slidably received within channels 18 and 19 cut in the inner wall of contoured side boards 12 and 13 of the frame, the channels following the contours of the boards. It is therefore a simple matter to pull the bed mat through the channels and thereby attach the bed to the frame of the couch.

The contour of dowel bed 17 which follows the contour of the couch frame is such as to define an intermediate region 20 for receiving the posterior of a reclining occupant, a front region 21 for receiving the thighs and legs of the occupant, and a rear region 22 for receiving the back and head of the occupant.

Figures 8, 9, 10, 11, 12, 13, 14:
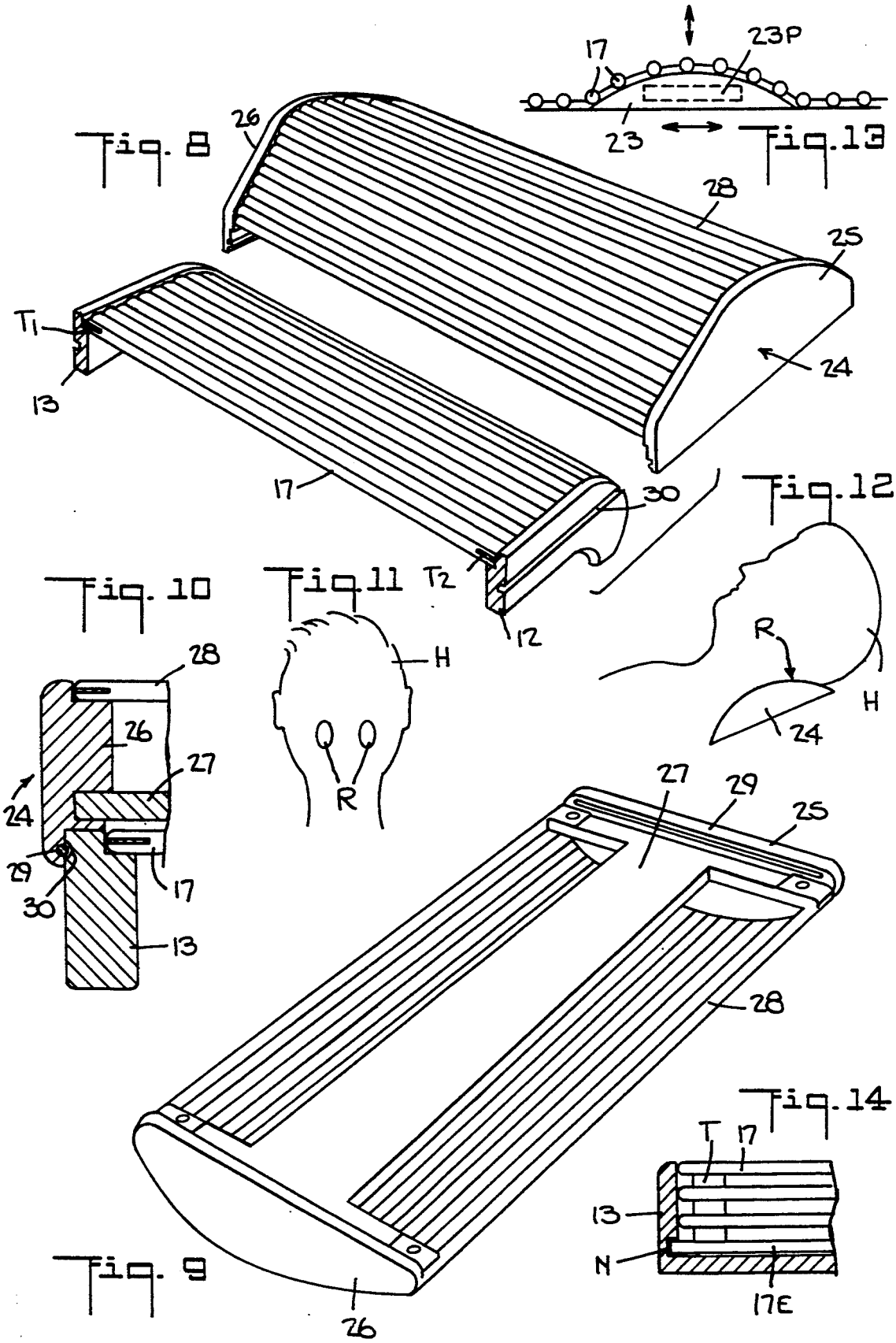
FIG. 8 illustrates, in perspective, the head rest and the end of the couch frame onto which it is slidably attached.
FIG. 9 is a perspective view of the head rest as seen from the underside.
FIG. 10 is a sectional view showing how the head rest slides on the frame of the couch.
FIG. 11 illustrates the occipital region in the back of the skull of the occupant of the lounge chair.
FIG. 12 illustrates the relationship of the head of the occupant to the head rest of the chair.
FIG. 13 illustrates the cam action of the lower back rest of the chair.
FIG. 14 illustrates the manner in which the dowel bed of the lounge chair is locked to its frame.

As shown separately in FIG. 14, the end dowels 17E on dowel bed 17 at the front and rear ends of the mat are longer than the other dowels which form this bed and are joined together by fabric tapes T. These longer dowels 17E fit into a notch N in the side boards 12 and 13 at the front and rear thereof to lock the mat in place.

Since individuals vary in shape and size, it is necessary to adjust the contour of dowel bed 17 so that it conforms to that of the particular individual who reclines therein. To this end, slidable along side boards 12 and 13 of the couch frame is a back rest 23 underlying dowel bed 17. The back rest produces a hump or arcuate bulge on the rear section 22 of the dowel bed in the lower back portion thereof. Back rest 23 is slidable to a position at which it accommodates the sacral or lower lumbar region of the reclining individual. Thus when an individual occupies the bed, he will shift back rest 23 to a position which conforms to his lower back curvature.

Also provided is a head rest 24 which is slidable on the side boards of the frame along the rear region 22 of the dowel bed in the head portion of this region to produce a pillow at a position conforming the contour of the bed to the curvature of the neck and head of the occupant. Head rest 24 is shifted by the occupant of the bed to that position he finds most comfortable.

Thus the slidable back rest 23 and the head rest 24 make it possible to conform the bed of the couch to the actual contour of the individual occupying the bed. The contour of the front region 21 of the bed is fixed, for it will comfortably accommodate the thighs and legs of almost any individual.

The structure of head rest 24 and its relationship to the couch frame are illustrated separately in FIGS. 8 to 10. It will be seen that head rest 24 is constituted by a pair of arched side boards 25 and 26 in parallel relation, bridged by a cross piece 27. The arched side boards support a similarly arched array of dowels 28 whose ends are received in channels in the inner walls of the arched side boards. Attached to the inner walls of the arched side boards and parallel to their flat base is a straight male bead 29 which is slidable within a straight female channel 30 in the side boards of the frame. Thus the arched dowels 28 of head rest 24 merges with the dowels 17 of the bed so that the contour of the bed is effectively modified by the arch. Head rest 24 is detachable from the lounge chair and may therefore be used separately.

Head rest 24 is adapted to be engaged by the occipital region in the region of the skull of the occupant's head. This occipital region R is shown in FIG. 11. The occipital bone is the bone which forms the posterior portion of the skull and occupital lobe is the posterior lobe of the cerebrum. The occipital lobe is known to be a pressure point, and when pressure is applied thereto, this acts to take the pressure off the muscles in the face, and in doing so to release muscle tension in the face and jaws. Those individuals who suffer from clenching of their jaw muscles or subconscious tension in their face and jaw can be treated by applying pressure to the occipital region to release this tension.

Dowels 28 included in head rest 24 have a smaller diameter than those which form the bed of the lounge chair and dowels 28 are therefore more flexible. The contour of the arched side boards 25 and 26 of head rest 24 is such that the array of dowels 28 which follow the contour engage the rear of the skull of the head H of the occupant of the chair and apply pressure to the occipital region R to relieve tensions, as shown in FIG. 12.

Back rest 23, as shown separately in FIG. 13, is composed of a pair of parallel wedge slides or cams held together by a cross piece 23 P. As back rest 23 is shifted along the couch frame up or down, it raises dowel bed 17. The back rest is shifted to a position to conform the raised dowel bed 17 to the lower lumbar area of the occupant of the couch, so that the contour of the bed follows that of the occupant's body.

Base 11, as shown in FIGS. 1 to 3, is composed of a pair of parallel side panels 30 and 31 which form the side walls of a carriage having end walls 32 and 33, bottom walls 34 and 35, and rollers or casters 36 attached thereto so that the lounge couch can be wheeled to any desired site.

The side boards 12 and 13 of the couch frame are each provided at their midsection, as shown in FIG. 3, with an arcuate cam 37 that is received within an arcuate slot formed in each of side panels 30 and 31 of the base. This makes it possible to rock the couch so as to adjust its angle relative to the base, and this way lower or raise the front and rear regions of the couch bed, as desired.

Figure 4:
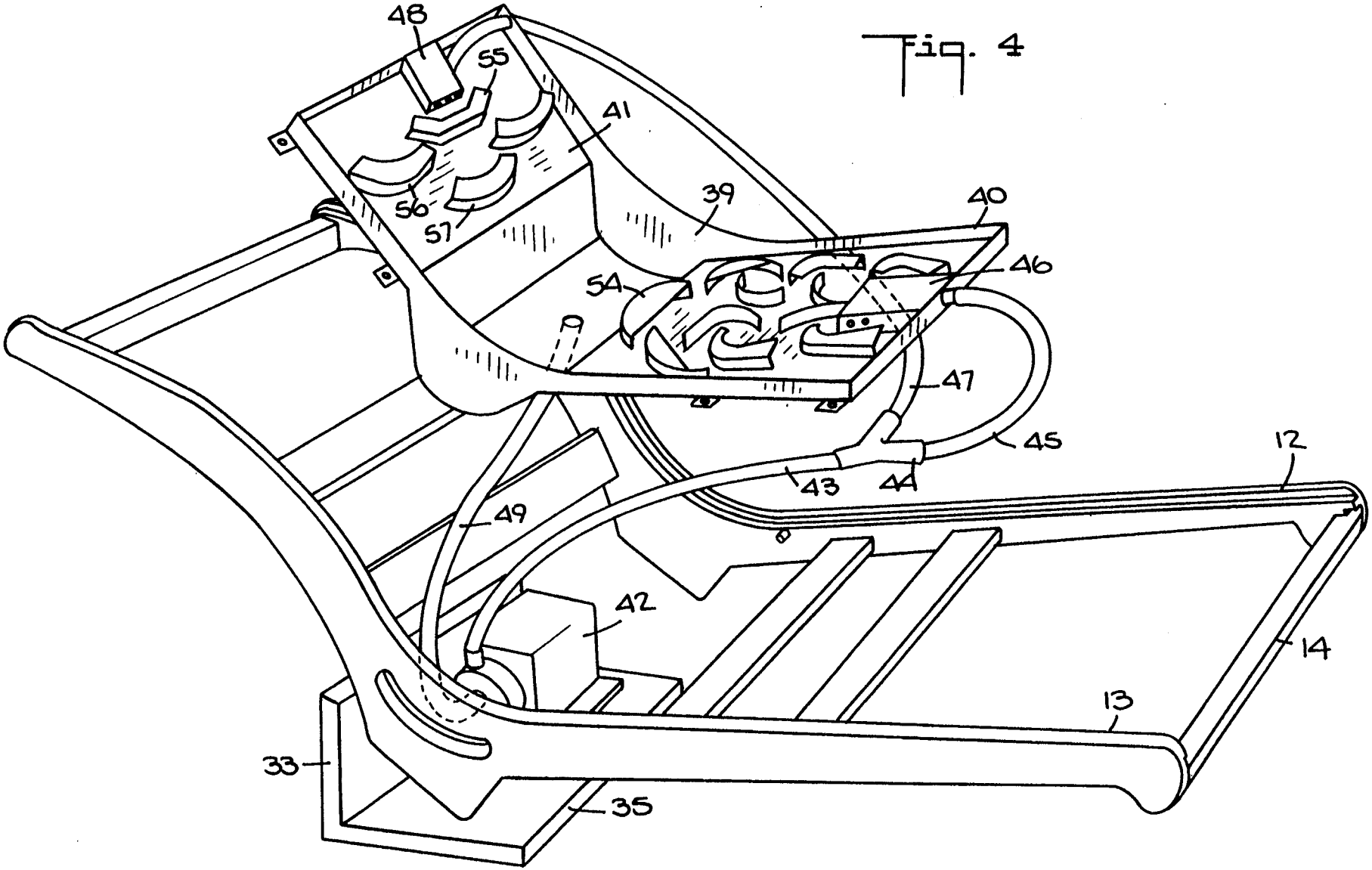
FIG. 4 is similar to FIG. 3, except that now the water trough has been detached from the frame and raised to show the pipe couplings between the water trough and a pump mounted in the base of the chair.
Figure 5:
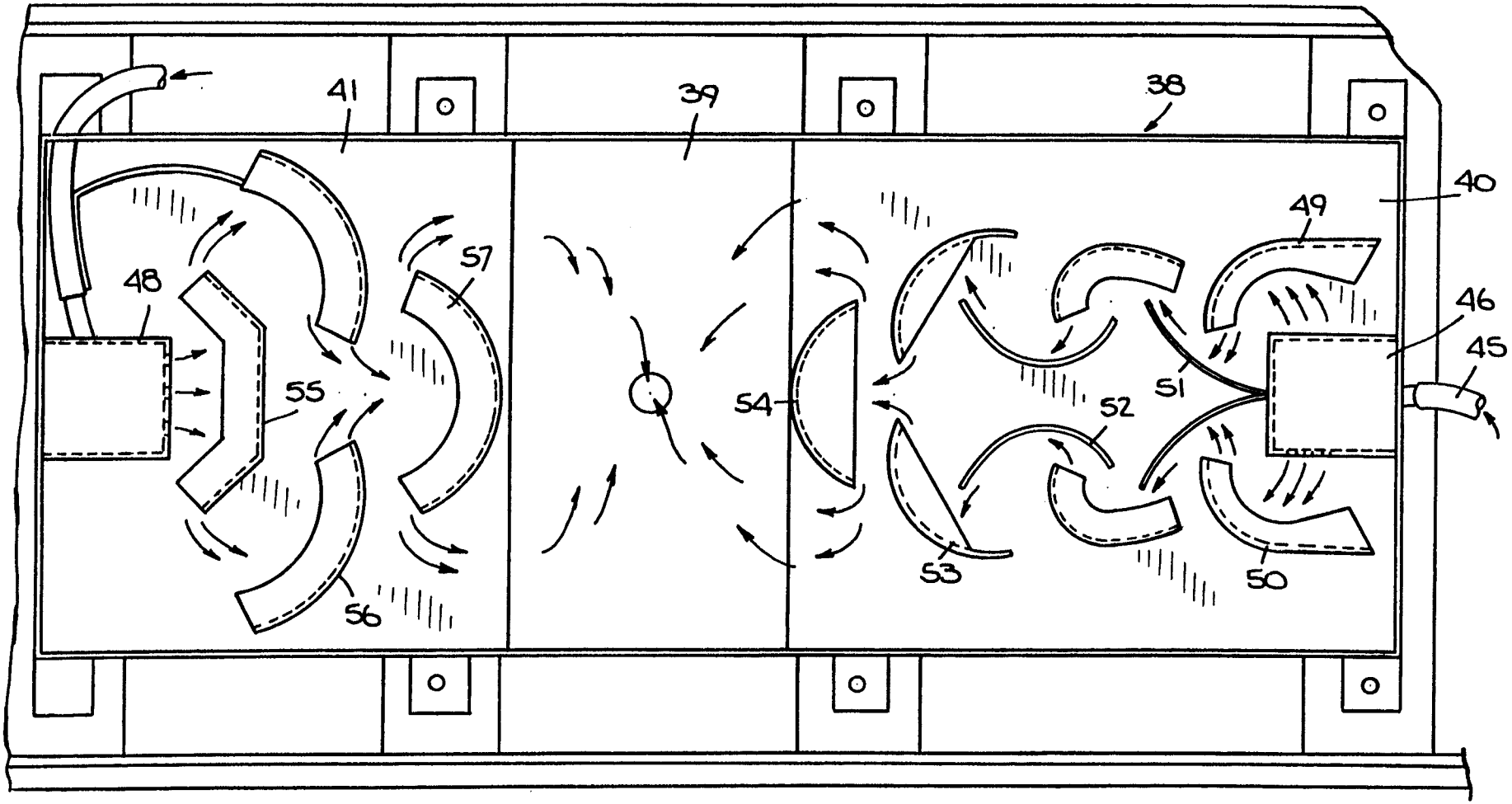
FIG. 5 is a top view of the water trough illustrating the manner in which water cascades down from the waterfall sections into the intermediate sump section of the trough.
Figure 6:
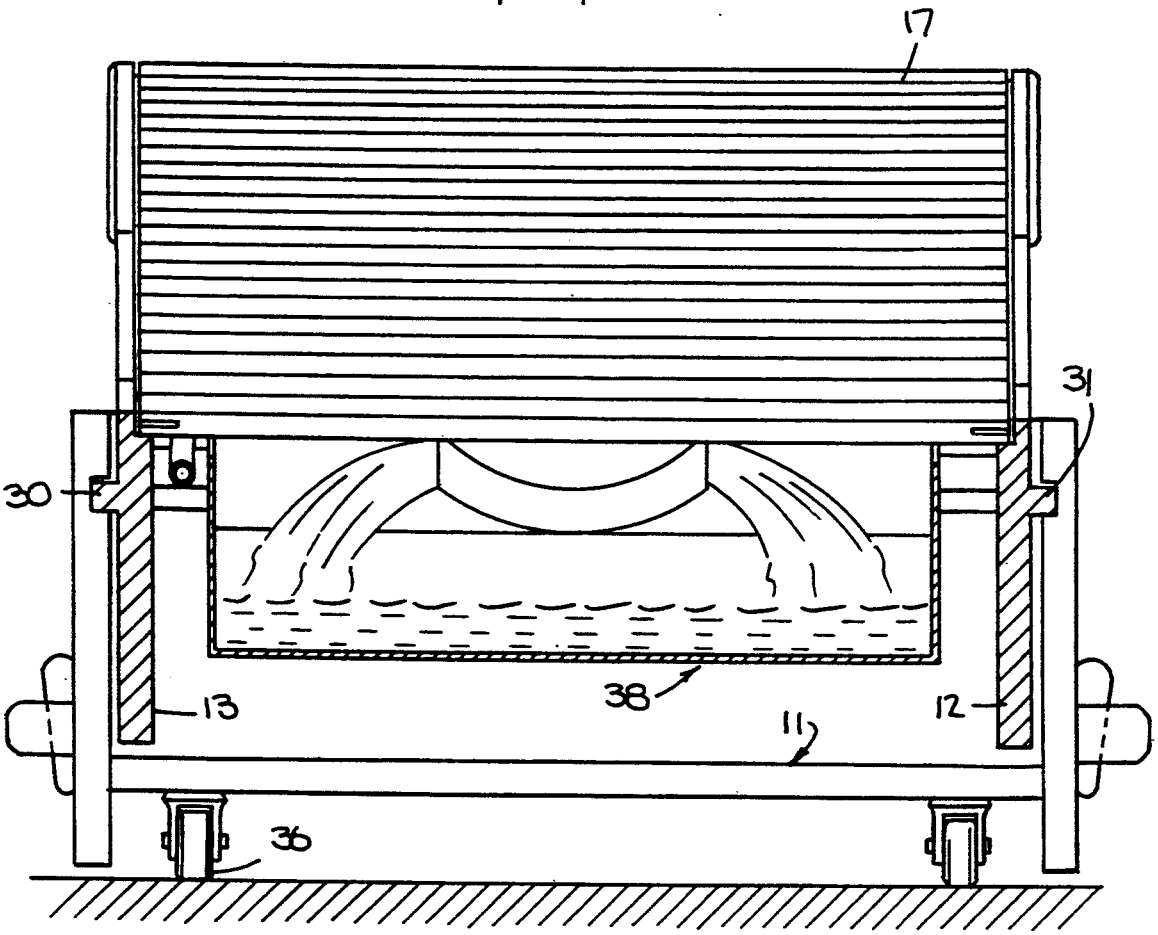
FIG. 6 is a transverse section in the plane indicated by line 6—6 in FIG. 2.
Figure 7:
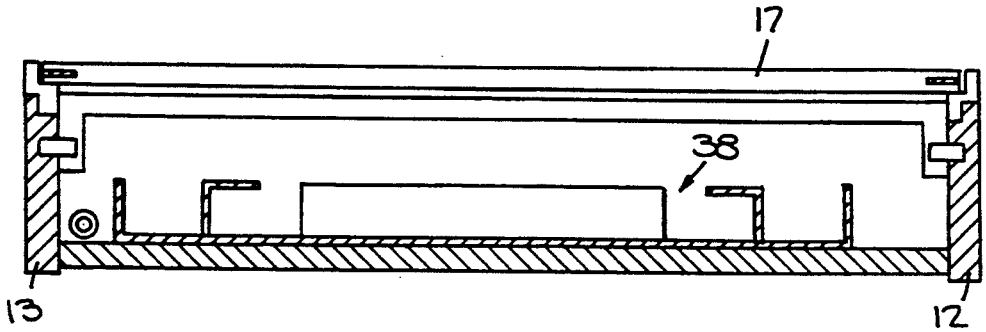
FIG. 7 is a transverse section in the plane indicated by line 7—7 in FIG. 2.

As best seen in FIGS. 3 and 4, secured to the frame of the couch is a contoured water trough, generally designated by numeral 38, having a reservoir section 39 on one side of which is a front waterfall section 41 and on the other side a rear waterfall section 40. Contoured water trough 38 underlies the contoured dowel bed 17, the sump or reservoir section corresponding to the intermediate region of the bed, the front section of the trough corresponding to the front region and the rear section to the rear region of the bed.

Supported on bottom wall 35 of base 11 is an electrically-powered water pump 42 whose water output is fed by a flexible tube 43 to a Y-junction 44. The motor for this pump is shielded so that the magnetic field emanating therefrom is confined and does not act to attract negative ions. From one output of this junction water is fed through a tube 45 by the input nozzle 46 of the front waterfall section 40 of the water trough. From the other output of this junction, water is fed through a tube 47 to the input nozzle 48 of the rear waterfall section 41 of the trough.

The water flowing down the front and rear waterfall sections 40 and 41 are collected in sump section 39 from which the water is fed through tube 49 back to pump 42 which recirculates the water through the water trough system.

The water trough is formed of copper, brass, or other suitable metal. Welded or otherwise affixed to the surface of the front waterfall section 41 are shaped deflectors, such as deflectors 49 to 54. These are so curved and situated as to cause water ejected from opposing sides of input nozzle 46 to flow in circuitous paths from the input to the output of this section and then dump into sump section 39.

Also coupled to the rear waterfall section 41 are shaped metallic deflectors, such as deflectors 55, 56 and 57. These are so situated as to cause water ejected from the front of input nozzle 48 to flow in a circuitous path from the input to the output of this section and then dump into sump section 39.

The purpose of these deflectors is to intercept and divert the flow of water so that the water cascades down the waterfall sections into the sump section. The deflectors which act as vibrating tines are configured so that those in the front section waterfall section produce low tones and those in the rear waterfall section produce high pitched tones. In the course of this activity, the deflectors, which are struck by the flowing water at different points in time, produce trickling high and low tones as well as other sounds which simulate those of a flowing brook in which a water stream runs over a bed of pebbles and rocks. The velocity of water flow is controllable by valves which are adjustable to vary the flow rate of water fed into the respective waterfall sections of the trough and thereby the intensity or volume of the generated sounds.

Because the waterfall sections break up and agitate the water impinging on the deflectors, I believe this gives rise to the release of negative ions, and it also acts to oxygenate the water. These ions pass through the spaces between the dowels in the bed which overlies the water trough, causing the atmosphere enveloping the occupant of the bed to be rich in negative ions and giving the occupant the beneficial effects of such ions.

And because of this turbulent water activity and ambient heat from the motor-driven pump, a warm mist is generated which rises from the trough and passes through the spaces between the dowels in the bed to humidify the ambient atmosphere enveloping the occupant of the bed.

Unlike electrically-operated sound generators, electrically-powered humidifiers and negative-ion generators, with a circulating water trough system in accordance with the invention incorporated in the lounge chair, the moist, negatively-charged atmosphere and the sounds simulating a running brook are the natural consequences of water activity, The occupant of the chair who is exposed to this activity while in a reclining and comfortable position will in due course experience a release of tension and a reduction in psychic stress restoring his sense of well being.

In contradistinction to a lounge chair which includes motors to effect vibration of the chair and to thereby stimulate and massage the occupant, a chair in accordance with the invention is passive. Though passive, it induces in the occupant a release of stress and a sense of tranquility and relaxation. By raising the legs of the occupant higher than his head, this increases blood flow back to the heart. And by firmly supporting the body on a bed of spaced dowels, the body is allowed to breathe, this also being conducive to a relaxed state.

In the water system arrangement illustrated in the figures, electrically-powered water pump 42 is mounted on the base of the chair and its output is coupled by tubing through a Y-junction 44 to the input nozzle 48 of the front waterfall section and the input nozzle 46 of the rear waterfall section of trough 38. Alternatively, the water system arrangement may be such as to render the system self-sufficient and independent of the base whose structure can then be simplified.

In the alternative arrangement, pump 42 is placed within the sump section 39 of the trough fat a position where it will not interfere with the flow of water into this section. The pump, so placed, is coupled by tubing, all of which is disposed within the trough through a Y-junction to the input nozzles. In practice, a valve may be incorporated in the Y-junction, the valve being adjustable to vary the relative volume of water fed into the input nozzles of the front and rear waterfall sections 40 and 41. In this way, the water distribution pattern of the system and the resultant sound effects may be adjusted.

While there has been shown and described a preferred embodiment of an environmentally-controlled lounge chair in accordance with the invention, it will be appreciated that many changes and modifications may be made therein without, however, departing from the essential spirit thereof.

I claim:

1. A lounge chair comprising:

(a) a base;

(b) a couch mounted on the base and including a frame supporting an array of parallel dowels in spaced relation forming a bed on which an occupant of the chair may recline, said array being contoured to define an intermediate region to accommodate the posterior of the occupant, a front region to accommodate the thighs and legs of the occupant, and a rear region to accommodate the back and head of the occupant;

(c) a water trough supported in said frame below the bed, said trough being contoured to define a sump section and front and rear waterfall sections, each having an input; and (d) pump means supported on said base to supply water into the inputs of the front and rear waterfall sections, said waterfall sections including means to break up water flow and to cause the water to cascade into and be collected in the sump section from which it is returned to the pump means for recirculation, the breakup of water flow resulting in the sounds simulating those of a running brook.

2. A lounge chair as set forth in claim 1, wherein said pump means is driven by a motor from which heat emanates serving to warm the water to produce a warm moist air.

3. A lounge chair as set forth in claim 1, wherein said couch is angularly adjustable relative to said base, whereby the front and rear regions of the bed may be raised or lowered.

4. A lounge chair as set forth in claim 1, wherein said couch and base are formed substantially of wood.

5. A lounge chair as set forth in claim 1, wherein said frame is formed of a pair of parallel side boards, each having cut along its inner wall a contoured channel which receives an end of the dowels in the array and maintains the array of dowels in a contoured configuration.

6. A lounge chair as set forth in claim 5, in which said base is formed by a pair of panels constituting the side walls of a carriage on which said pump means is mounted, the side boards of the couch having cams thereon which are received in arcuate slots in said panels, whereby the couch is adjustable on said base.

7. A lounge chair as set forth in claim 1, wherein said waterfall sections each have a set of water deflectors mounted therein that are so shaped and situated as to deflect and divert water impinging thereon to break up said water flow.

8. A lounge chair as set forth in claim 7, wherein said deflectors are of metal and function as sound-producing tines.

9. A lounge chair as set forth in claim 8, wherein the deflectors in the front waterfall section are configured to produce low tones and those in the rear waterfall section to produce relatively high tones.

10. A lounge chair as set forth in claim 1, wherein said pump means is coupled through a tube leading to a Y-junction, one output of which is coupled to the input of the front waterfall section, the other output being coupled to the input of the rear waterfall section.

11. A lounge chair as set forth in claim 1, further including a back rest slidable on said couch frame in said rear section and having a hump formation so as to conform the back to the lower lumbar region of the occupant.

12. A lounge chair as set forth in claim 1, further including a head rest slidable on the rear section of the couch to a position underlying the head of the occupant.

13. A lounge chair as set forth in claim 12, wherein said head rest has a contoured surface which engages occipital pressure points on the rear of the occupant's skull.

14. A lounge chair as set forth in claim 13, wherein said contoured surface of the head rest is defined by an array of parallel dowels whose diameter is smaller than the dowels forming the bed whereby the head rest dowels are relatively flexible.

* * * * *